US006084358A

United States Patent [19]

Dolson

[11] Patent Number: 6,084,358

[45] Date of Patent: Jul. 4, 2000

[54] GARAGE DOOR MOUNTED LIGHT

[76] Inventor: Charles W. Dolson, P.O. Box 60548, Boulder City, Nev. 89006

[21] Appl. No.: 09/141,178

[22] Filed: Aug. 27, 1998

[51] Int. Cl.[7] ..... H05B 37/02

[52] U.S. Cl. ..... 315/226; 315/362

[58] Field of Search ..... 315/226, 209 R, 315/216, 250, 362

[56] References Cited

U.S. PATENT DOCUMENTS

| | | | |
|---|---|---|---|
| 4,494,012 | 1/1985 | Coker | 307/132 |
| 5,402,105 | 3/1995 | Doyle et al. | 340/539 |
| 5,969,637 | 10/1999 | Doppelt et al. | 340/825.69 |

*Primary Examiner*—Don Wong
*Assistant Examiner*—Chuc D. Tran

[57] ABSTRACT

A garage door mounted lighting system is provided including a garage with a side opening and a ceiling. The garage further includes a garage door slidably mounted along tracks extending along side edges of the opening and the ceiling for allowing the sliding of the garage door between an open orientation in parallel with the ceiling and a closed orientation for closing the opening of the garage. Further included is a light mounted on an inner face of the garage for illuminating upon the receipt of power. A switch is connected between a power source and the light for providing power to the light.

4 Claims, 2 Drawing Sheets

21
24
28
22
26
14
30
18
20

TILT SWITCH
32

20
18
120 VAC
POWER
LAMP BALLAST
FLOURESCENT LAMP TUBES

GARAGE DOOR MOUNTED LIGHT

BACKGROUND OF THE INVENTION

1. Field of the Invention

The present invention relates to garage lights and more particularly pertains to a new garage door mounted light for providing light within a garage when an associated garage door is open.

2. Description of the Prior Art

The use of garage lights is known in the prior art. More specifically, garage lights heretofore devised and utilized are known to consist basically of familiar, expected and obvious structural configurations, notwithstanding the myriad of designs encompassed by the crowded prior art which have been developed for the fulfillment of countless objectives and requirements.

Known prior art garage lights include U.S. Pat. No. 5,645,147; U.S. Pat. No. 4,378,473; U.S. Pat. No. 2,070,561; U.S. Pat. No. 5,528,477; U.S. Pat. No. 2,327,230; and U.S. Pat. No. Des. 385,379.

In these respects, the garage door mounted light according to the present invention substantially departs from the conventional concepts and designs of the prior art, and in so doing provides an apparatus primarily developed for the purpose of providing light within a garage when an associated garage door is open. SUMMARY OF THE INVENTION In view of the foregoing disadvantages inherent in the known types of garage lights now present in the prior art, the present invention provides a new garage door mounted light construction wherein the same can be utilized for providing light within a garage when an associated garage door is open.

The general purpose of the present invention, which will be described subsequently in greater detail, is to provide a new garage door mounted light apparatus and method which has many of the advantages of the garage lights mentioned heretofore and many novel features that result in a new garage door mounted light which is not anticipated, rendered obvious, suggested, or even implied by any of the prior art garage lights, either alone or in any combination thereof.

To attain this, the present invention is adapted for use with a garage including a side opening and a ceiling having a lamp mounted on a central extent thereof. The garage further includes a garage door slidably mounted along tracks extending along side edges of the opening and the ceiling. The garage door is thus adapted to slide to an open orientation in parallel with the ceiling. Further, the garage door is adapted to assume a closed orientation for closing the opening of the garage. As shown in FIG. 2, the garage door blocks the lamp in the open orientation. For reasons that will soon become apparent, a ballast is mounted on an inner face of the garage door. As shown in FIGS. 1 & 2, the present invention includes an elongated fluorescent light mounted to the ballast on the inner face of the garage door. Such fluorescent light is mounted in parallel with a top edge of the garage door and further distanced therefrom a distance ⅓ a height of the garage door. In use, the fluorescent light serves to illuminate upon the receipt of power. Also included is a switch assembly having a box mounted to the ballast on the inner face of the garage door opposite the fluorescent light. As shown in FIG. 3, a pair of horizontally oriented conductive rods are mounted between side faces of the box in perpendicular relationship therewith. The rods are positioned a unique distance from an inner face of the box.

Further, a conductive pivot member is pivotally mounted between the side faces of the box intermediate the conductive rods. A weight is mounted on an end of the pivot member. By this structure, ends of the pivot member abut the rods when the garage door is in the open orientation. These ends of the pivot member further remain spaced from the rods when the garage door is in the closed orientation. As such, a tilt switch is defined. The switch assembly further includes a toggle switch mounted on the inner face of the box. Such toggle switch is connected between the rods with a first position for electrically connecting the same. In a second position, the toggle switch is adapted for preventing electrical communication between the rods. As shown in FIG. 4, the rods are connected between a power source and the fluorescent light with the tilt switch and the toggle switch remaining in parallel. The switch assembly thus functions to supply the fluorescent light with power manually in an unconditional manner and further automatically when the garage door resides in the open orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garage door mounted light apparatus and method which has many of the advantages of the garage lights mentioned heretofore and many novel features that result in a new garage door mounted light which is not anticipated, rendered obvious, suggested, or even implied by any of the prior art garage lights, either alone or in any combination thereof.

It is another object of the present invention to provide a new garage door mounted light which may be easily and efficiently manufactured and marketed.

It is a further object of the present invention to provide a new garage door mounted light which is of a durable and reliable construction.

An even further object of the present invention is to provide a new garage door mounted light which is susceptible of a low cost of manufacture with regard to both materials and labor, and which accordingly is then susceptible of low prices of sale to the consuming public, thereby making such garage door mounted light economically available to the buying public.

Still yet another object of the present invention is to provide a new garage door mounted light which provides in the apparatuses and methods of the prior art some of the advantages thereof, while simultaneously overcoming some of the disadvantages normally associated therewith.

Still another object of the present invention is to provide a new garage door mounted light for providing light within a garage when an associated garage door is open.

Even still another object of the present invention is to provide a new garage door mounted light that is adapted for use with a garage having a side opening and a ceiling. The garage further includes a garage door slidably mounted along tracks extending along side edges of the opening and the ceiling for allowing the sliding of the garage door between an open orientation in parallel with the ceiling and a closed orientation for closing the opening of the garage. Further included is a light mounted on an inner face of the garage for illuminating upon the receipt of power. A switch is connected between a power source and the light for providing power to the light.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
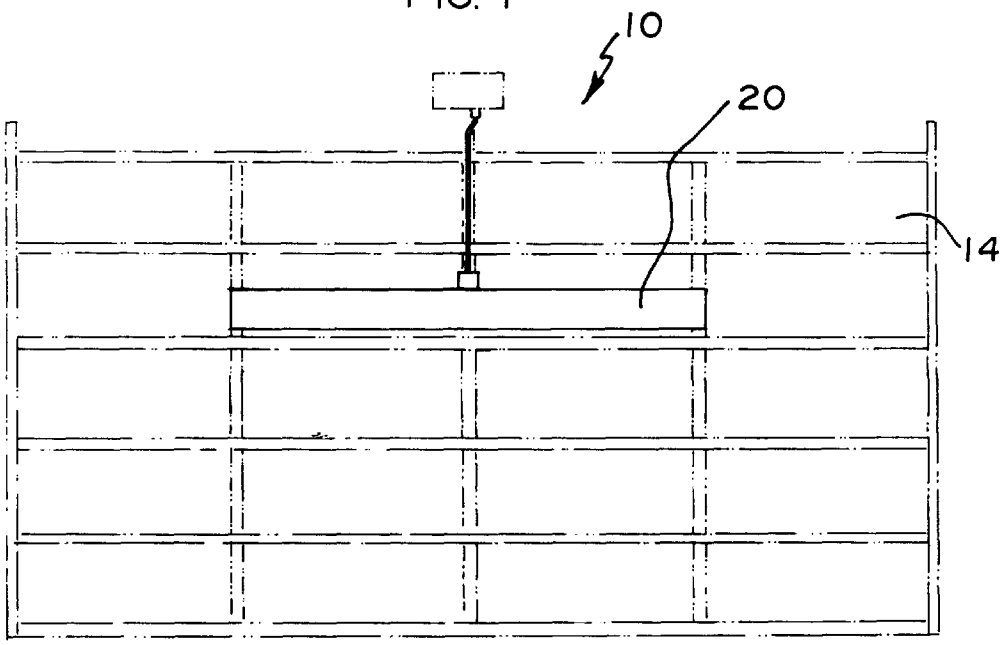
FIG. 1 is a rear view of a new garage door mounted light according to the present invention.

With reference now to the drawings, and in particular to FIGS. 1 through 4 thereof, a new garage door mounted light embodying the principles and concepts of the present invention and generally designated by the reference numeral 10 will be described.

Figure 2:
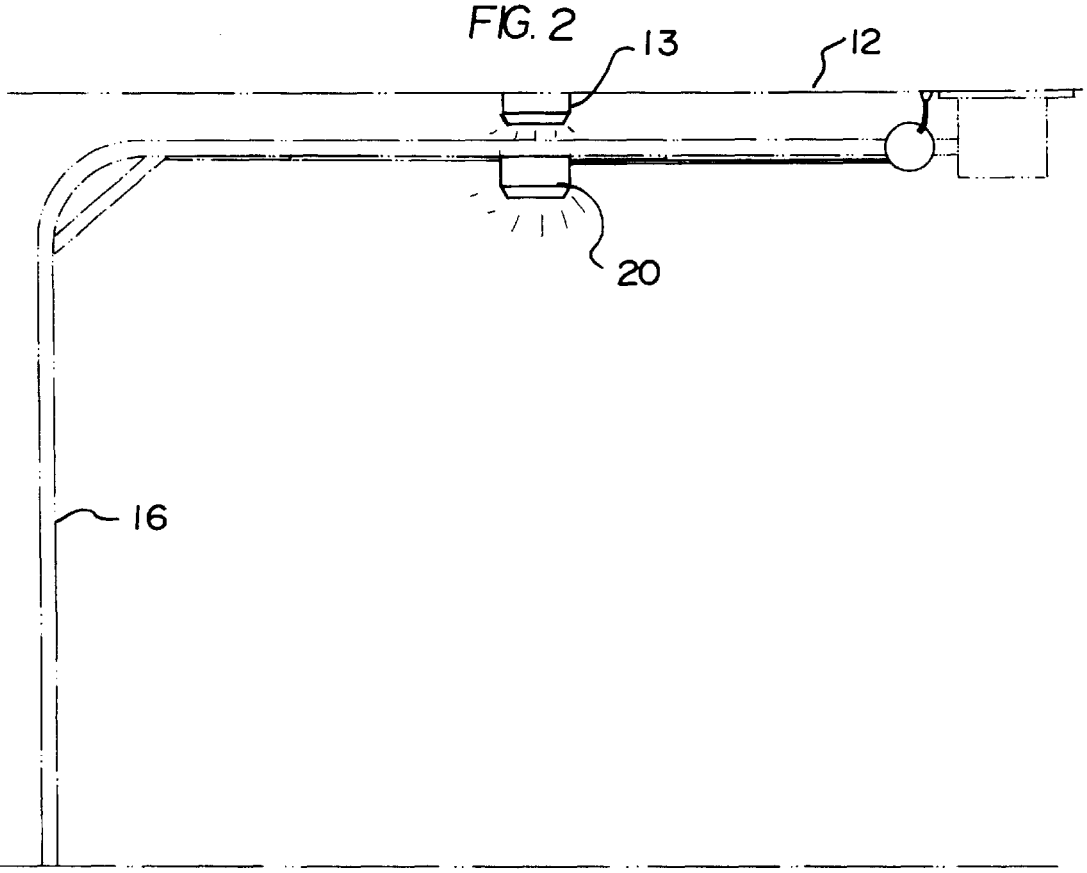
FIG. 2 is a side view of the present invention.

The present invention, designated as numeral 10, is adapted for use with a garage 12 including a side opening and a ceiling having a lamp 13 mounted on a central extent thereof. The garage further includes a garage door 14 slidably mounted along tracks 16 extending along side edges of the opening and the ceiling. The garage door is thus adapted to slide to an open orientation in parallel with the ceiling. Further, the garage door is adapted to assume a closed orientation for closing the side opening of the garage. As shown in FIG. 2, the garage door blocks the lamp in the open orientation. For reasons that will soon become apparent, a ballast 18 is mounted on an inner face 21 of the garage door.

As shown in FIGS. 1 & 2, the present invention includes an elongated fluorescent light 20 mounted on the ballast on the inner face of the garage door. In the alternative, any other type of light may be employed including, but not limited to a halogen light or incandescent lamp. As shown in the Figures, the fluorescent light is mounted in parallel with a top edge of the garage door and further distanced therefrom a distance ⅓ a height of the garage door. In use, the fluorescent light serves to illuminate upon the receipt of power.

Figure 3:
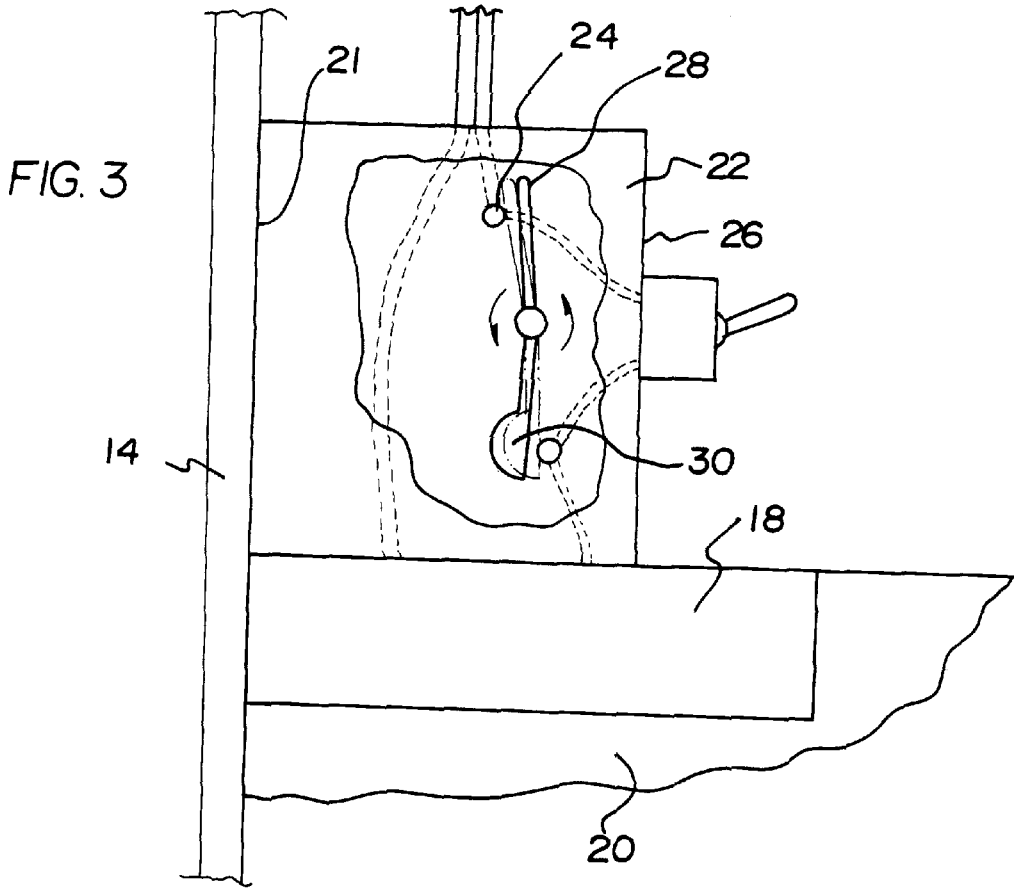
FIG. 3 is a detailed sectional side view of the switch assembly of the present invention.

Also included is a switch assembly having a box 22 mounted to the ballast on the inner face of the garage door opposite the fluorescent light. As shown in FIG. 3, a pair of horizontally oriented conductive rods 24 are mounted between side faces of the box in perpendicular relationship therewith. The rods are each positioned a unique distance from an inner face 26 of the box. Further, a conductive pivot member 28 is pivotally mounted between the side faces of the box intermediate the conductive rods. A weight 30 is connected to an end of the pivot member.

By this structure, ends of the pivot member abut the rods when the garage door is in the open orientation. These ends of the pivot member further remain spaced from the rods when the garage door is in the closed orientation. As such, a tilt switch is defined. The switch assembly further includes a toggle switch 32 mounted on the inner face of the box. Such toggle switch is connected between the rods with a first position for electrically connecting the same. In a second position, the toggle switch is adapted for preventing electrical communication between the rods.

Figure 4:
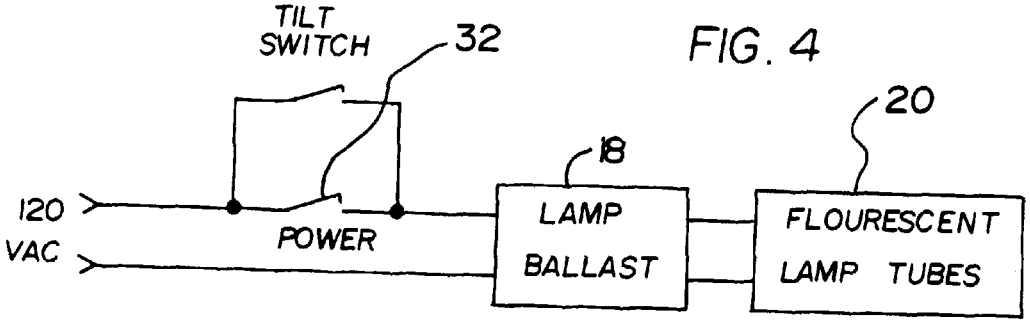
FIG. 4 is a schematic diagram of the present invention.

As shown in FIG. 4, the rods are connected between a power source and the fluorescent light with the tilt switch and the toggle switch being connected in parallel. The connection with the power source is preferably accomplished by way of an elongated, coiled or retractable cord which runs upwardly along the garage door and connects to the power source that is connected to the lamp of the garage. In the retractable embodiment, the cord is reeled as the garage door is raised. In yet another embodiment, the cord is excluded in favor of contacts on the ceiling and garage door. In this embodiment, the contacts abut only when the garage door is open. As such, the toggle switch may be excluded.

In use, the switch assembly functions to supply the fluorescent light with power manually in an unconditional manner. The switch assembly further supplies the fluorescent light with power automatically when the garage door resides in the open orientation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garage door mounted lighting system comprising, in combination:

a garage with a side opening and a ceiling having a lamp mounted on a central extent thereof, the garage further including a garage door slidably mounted along tracks extending along side edges of the opening and the ceiling for allowing the sliding of the garage door between an open orientation in parallel with the ceiling and a closed orientation for closing the opening of the garage, wherein the garage door blocks the lamp in the open orientation;

a ballast mounted on an inner face of the garage door;

an elongated fluorescent light mounted to the ballast on the inner face of the garage door in parallel with a top edge of the garage door and distanced therefrom a distance ⅓ a height of the garage door, the fluorescent light adapted to illuminate upon the receipt of power; and a switch assembly including a box mounted to the ballast on the inner face of the garage door opposite the fluorescent light, a pair of horizontally oriented conductive rods mounted between side faces of the box in perpendicular relationship therewith wherein the rods are positioned a unique distance from an inner face of the box, a conductive pivot member being pivotally mounted between the side faces of the box intermediate the conductive rods with a weight mounted thereon such that ends of the pivot member abut the rods when the garage door is in the open orientation and further remain spaced from the rods when the garage door is in the closed orientation, the switch assembly further including a toggle switch mounted on the inner face of the box and connected between the rods with a first position for electrically connecting the same and a second position for preventing electrical communication between the rods, the rods connected between a power source and the fluorescent light in order to illuminate the fluorescent light manually in an unconditional manner and further automatically upon the garage door residing in the open orientation.

2. A garage door mounted lighting system comprising:

a garage with a side opening and a ceiling, the garage further including a garage door adapted for sliding between an open orientation in parallel with the ceiling and a closed orientation for closing the opening of the garage;

a light mounted on an inner face of the garage for illuminating upon the receipt of power;

a switch connected between a power source and the light for supplying the light with power;

wherein the switch is adapted to automatically supply power to the light only when the garage door is in the open orientation; and wherein the switch includes a pivot member with a weight mounted thereon.

3. A garage door mounted lighting system as set forth in claim 2 wherein the switch includes a toggle switch.

4. A garage door mounted lighting system as set forth in claim 3 wherein the switch is mounted on the garage door.

* * * * *